US005611152A

United States Patent [19]

Richard et al.

[11] Patent Number: 5,611,152

[45] Date of Patent: Mar. 18, 1997

[54] SHOE SOLE CONSTRUCTION CONTAINING A COMPOSITE PLATE

[75] Inventors: Daniel J. Richard, Rye, N.H.; Joseph R. Frazier, Jr., Mansfield, Mass.

[73] Assignee: Converse Inc., North Reading, Mass.

[21] Appl. No.: 650,588

[22] Filed: May 20, 1996

Related U.S. Application Data

[63] Continuation of Ser. No. 397,406, Mar. 2, 1995, abandoned.

[51] Int. Cl.[6] ..... A43B 13/12; A43B 13/28

[52] U.S. Cl. ..... 36/28; 36/30 R; 36/27; 36/37

[58] Field of Search ..... 36/25 R, 27, 28, 36/30 R, 31, 35 R, 37, 38, 76 R, 84, 88, 103, 107, 108, 114

[56] References Cited

U.S. PATENT DOCUMENTS

| | | | |
|---|---|---|---|
| 180,819 | 8/1876 | Ames . | |
| 634,588 | 10/1899 | Roche . | |
| 1,602,675 | 10/1926 | Hurley . | |
| 2,001,821 | 5/1935 | Everston . | |
| 2,070,116 | 2/1937 | Cutillo . | |
| 3,586,003 | 6/1971 | Baker . | |
| 4,316,334 | 2/1982 | Hunt . | |
| 4,399,621 | 8/1983 | Dassler . | |
| 4,778,717 | 10/1988 | Fitchmun | 428/246 |
| 4,878,300 | 11/1989 | Bogaty | 36/35 R |
| 4,922,631 | 5/1990 | Anderie | 36/102 |
| 5,052,130 | 10/1991 | Barry et al. . | |
| 5,255,451 | 10/1993 | Tong et al. | 36/28 X |
| 5,319,866 | 6/1994 | Foley et al. | 36/91 |
| 5,325,611 | 7/1994 | Dyer et al. | 36/37 X |
| 5,381,608 | 1/1995 | Claveria | 36/35 R |
| 5,402,588 | 4/1995 | Graham et al. | 36/28 |

FOREIGN PATENT DOCUMENTS

| | | | |
|---|---|---|---|
| 0352807 | 1/1990 | European Pat. Off. . | |
| 1387967 | 4/1988 | U.S.S.R. | 36/28 |
| 2114869 | 9/1983 | United Kingdom . | |
| WO91/16830 | 11/1991 | WIPO . | |

OTHER PUBLICATIONS

Running Times, Apt. 1991, pp. 23 and 26.
Runers World, Apr. 1991, pp. 58, 72 and 73.

*Primary Examiner*—Marie D. Patterson
*Attorney, Agent, or Firm*—Howell & Haferkamp, L.C.

[57] ABSTRACT

A shoe sole construction includes an aperture provided through the shoe sole and a composite support plate covering over the aperture. The support plate in turn is covered over by a pad having a peripheral dimension larger than the support plate. The pad cushions the support plate so that its presence in the shoe sole is not detected by the shoe wearer's foot.

28 Claims, 1 Drawing Sheet

SHOE SOLE CONSTRUCTION CONTAINING A COMPOSITE PLATE

This application is a continuation of application Ser. No. 08/397,406 filed on Mar. 2, 1995, now abandoned.

BACKGROUND OF THE INVENTION (1) Field of the Invention

The present invention pertains to a shoe sole construction in which an aperture provided through the shoe sole is covered over by a composite support plate. The support plate in turn is covered over by a pad having a peripheral dimension larger than the support plate. The pad cushions the support plate so that its presence in the shoe sole is not detected by the shoe wearer's foot.

(2) Description of the Related Art

In the construction of shoe soles, composite materials such as fiberglass, graphite, and fiber-reinforced polymeric materials are being used in various different forms and for various different purposes. For example, U.S. Pat. No. 5,052,130 discloses a shoe sole that employs a spring plate in combination with its midsole. The spring plate is constructed of multiple layers, with each layer comprised of parallel carbon fibers imbedded in polymer. The fibers of successive layers are positioned at acute angles relative to each other giving the spring plate a stiffness that is anisotropic, being greater longitudinally than laterally. The spring plate formed in this manner provides the shoe with rearfoot stability, impact cushioning, arch support and forefoot propulsion. U.S. Pat. No. 4,878,300 discloses an athletic shoe having a sole comprised of parallel midsole layers with a shock dispersing plate disposed between the layers. The shock dispersing plate is constructed of fiberglass material. The plate covers over vertical openings centered within the heel area of the sole which penetrate the midsole and outsole layers and permit the shock dispersing plate to yield in the area of the openings. U.S. Pat. No. 5,319,866 discloses a composite arch member employed in a shoe sole where the arch member is constructed of a carbon-glass weave. The arch member provides support to the arch region of the foot and replaces midsole material which is removed from the arch area of the midsole to reduce the weight of the shoe sole.

While the use of fiberglass or graphite fiber composite plates in the construction of shoe soles provides beneficial characteristics to the shoe sole such as increased strength and reduced weight, frequently the comfort of the shoe wearer's foot on the shoe sole incorporating a composite plate is overlooked. It is an object of the present invention to provide a simplified shoe sole construction that includes a graphite/polymer composite plate that provides strength to support the shoe wearer's foot without sacrificing the comfort of the shoe wearer's foot.

SUMMARY OF THE INVENTION

The shoe sole construction of the invention is basically comprised of a midsole constructed of polyurethane or other similar midsole material, an outsole secured to the bottom surface of the midsole, and a composite plate constructed of a weave of graphite and glass fibers impregnated with a polymeric resin encapsulated within the midsole.

The outsole, in the preferred embodiment of the shoe sole construction, is comprised of two separate sections, a forefoot section and a heel section. The two outsole sections are constructed of a material having greater wear resistance characteristics than the material of the midsole. The forefoot outsole section is adhered to a forward area of the midsole underlying the forefoot region of the shoe wearer's foot. The heel outsole section is adhered to a rearward area of the midsole underlying the heel region of the shoe wearer's foot.

A pair of apertures are provided through the midsole and emerge from the bottom surface of the midsole intermediate the forward and rearward outsole sections. A first recessed cavity is formed in the top surface of the midsole directly over and communicating with the pair of apertures. A second recessed cavity is formed in the top surface of the midsole directly over and communicating with the first cavity. The first cavity has a perimeter wall surrounding the cavity and the second cavity has a perimeter wall surrounding the second cavity. The second cavity is larger than the first cavity and therefore the perimeter wall of the second cavity extends completely around and is spaced outwardly from the perimeter wall of the first cavity.

A composite plate is received in the first midsole cavity. The composite plate is preferably formed from a weave of graphite and glass fibers infused with polyester resin. The first midsole cavity has a perimeter configuration that corresponds to the peripheral configuration of the composite plate. Furthermore, the height of the first cavity perimeter wall or the depth to which the first cavity extends into the midsole corresponds to the thickness of the composite plate. With the composite plate positioned in the first midsole cavity, the plate is visible through the apertures from the exterior of the shoe sole. The periphery of the plate is positioned adjacent the perimeter wall of the first cavity and the top surface of the plate is substantially flush with the bottom surface of the second midsole cavity.

A pad of midsole material is inserted into the second cavity of the midsole and is adhered over the composite plate and the bottom surface of the second midsole cavity surrounding the plate, encapsulating the plate in the midsole. The midsole pad has a peripheral configuration that corresponds to the perimeter configuration of the second midsole cavity. The thickness of the pad also corresponds to the depth of the second cavity so that the top surface of the pad is substantially flush with the top surface of the midsole. Preferably, the midsole pad is constructed of a midsole material that enables the pad to compensate for the reduced softness of the midsole in the area of the composite plate due to the presence of the plate in the midsole. The pad is dimensioned larger than the peripheral dimensions of the midsole plate so that its peripheral dimensions extend beyond the peripheral edge of the plate and overlap midsole material surrounding the plate. This ensures that the edges of the plate cannot be felt by the shoe wearer's foot as the shoe sole is flexed in the area of the plate. In the preferred embodiment of the shoe sole construction, the midsole has a substantially consistent Shore hardness in a range of 55 to 60 across its top surface whether measured over the forefoot or heel regions of the midsole or over the intermediate arch region of the midsole encapsulating the composite plate.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
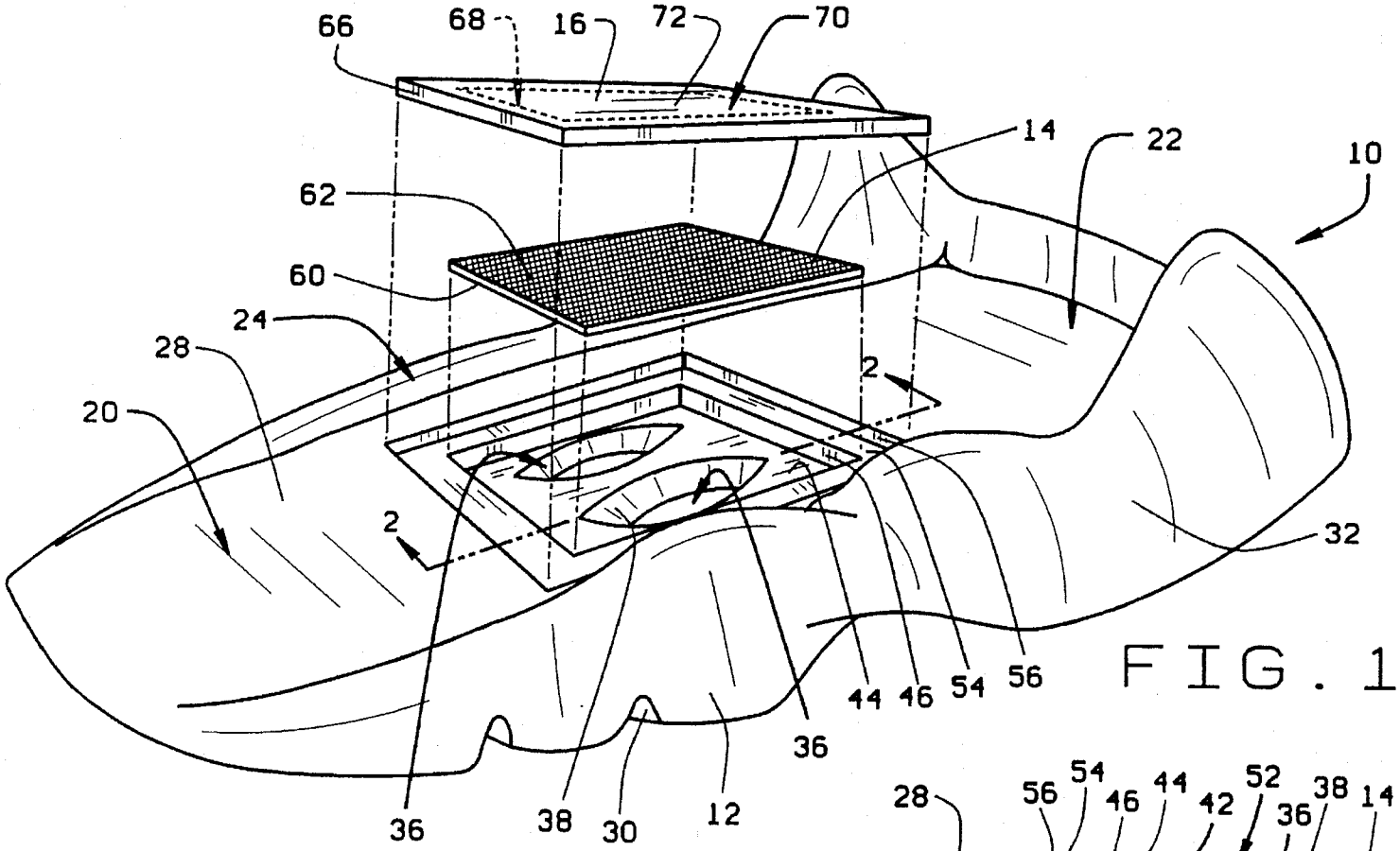
FIG. 1 is a pictorial exploded assembly view of the shoe sole construction of the present invention.

FIG. 1 shows the shoe sole construction of the present invention. The shoe sole 10 is basically constructed of an outsole (not shown), a midsole 12, a composite plate 14, and a midsole pad 16.

The outsole of the shoe construction in the preferred embodiment of the invention is comprised of two separate sections, a forefoot section and a heel section. The two outsole sections are constructed of a material having wear resistent characteristics as is conventional. The forefoot outsole section is adhered to a forward area of the underside of the midsole 12 and is not visible in FIG. 1. The forefoot outsole section underlies the forefoot of the shoe wearer's foot. The heel outsole section is adhered to a rearward area of the midsole 12 not visible in FIG. 1. The heel midsole section underlies the heel of the shoe wearer's foot.

The midsole 12 of the invention may be constructed from various different materials typically employed in constructing midsoles of shoes. In the preferred embodiment of the invention, the midsole 12 is constructed of polyurethane, a typical material employed in the construction of athletic shoes. These materials also include polyesters, ethylvinyl acetate (EVA), and other similar materials. The midsole may also be constructed of blends of these and other typical midsole materials. The material employed in constructing the midsole 12 will vary depending on the intended use of the shoe. For example, the material chosen to construct the midsole 12 will vary depending on whether cushioning characteristics or wear resistent characteristics are more important in the intended use of the shoe. The terms "midsole material" are intended to mean any material conventionally used in constructing shoe midsoles.

The midsole includes a forefoot midsole region 20, a heel midsole region 22, and an arch midsole region 24. The midsole 12 has a top surface 28 and a bottom surface 30. The midsole also has a peripheral sidewall 32 that extends completely around the shoe sole and defines a periphery of the shoe sole.

Figure 2:
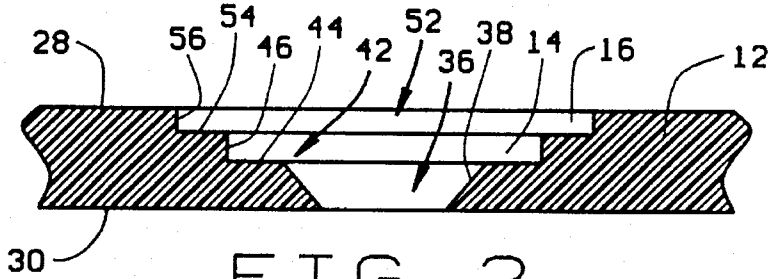
FIG. 2 is a partial cross section of the sole taken along the line 2—2 of FIG. 1.

In the arch midsole region 24, a pair of apertures 36 extend completely through the midsole between the top surface 28 and bottom surface 30. As best seen in FIG. 2, the apertures 36 emerge through the midsole bottom surface 30. Each aperture 36 has a perimeter wall 38, that is a wall that extends completely around and surrounds the aperture. In the preferred embodiment of the invention, there are two apertures as shown in FIG. 1. However, the number of apertures and their configurations may be changed from those shown.

A first cavity 42 is recessed into the midsole from the top surface 28. The first cavity 42 is positioned directly above and communicates with the apertures 36, meaning that the interior volume or void of the apertures is accessible from the interior volume or void of the first cavity. The first cavity is formed with a bottom surface 44 that is surrounded by a perimeter wall 46 of the cavity. The perimeter wall 46 has a predetermined vertical height to correspond to the thickness of the composite plate 14. The wall 46 also has a configuration that corresponds to a configuration of the peripheral edge of the composite plate 14 as will be explained. As best seen in FIG. 1, the perimeter wall 46 of the first cavity completely surrounds the apertures 36. Furthermore, as best seen in FIG. 1, the apertures 36 open through the first cavity bottom surface 44 so that each of the apertures is completely surrounded by the bottom surface.

A second cavity 52 is recessed into the midsole from the midsole top surface 28. As seen in FIG. 1, the second cavity 52 is positioned directly above the first cavity 42 and communicates with the first cavity. The second cavity 52 also communicates with the apertures 36 through the first cavity 42. The second cavity 52 is formed with a bottom surface 54 and a perimeter wall 56 that completely surrounds the bottom surface of the cavity. The second cavity perimeter wall 56 is larger than and completely surrounds the perimeter wall 46 of the first cavity. Therefore, the second cavity bottom surface 54 completely surrounds the first cavity 42 and the first cavity opens through the second cavity bottom surface 54. The second cavity perimeter wall 56 has a vertical height that corresponds to a thickness of the midsole pad 16. The perimeter wall 56 of the second cavity also has a configuration that corresponds to the configuration of a peripheral edge of the midsole pad 16 as will be explained.

The perimeter wall of the second cavity is surrounded by the midsole top surface and is spaced from the midsole peripheral sidewall 32, meaning that it does not intersect or meet with the sidewall. In a like manner, the first cavity perimeter wall 46 is spaced from the second cavity perimeter wall 56 and the perimeter walls 38 of the apertures.

The composite plate 14 is preferably formed from a weave of graphite and fiberglass fibers infused with a polyester resin. However, various different types of plate constructions may be employed. The plate may be constructed of a weave of fiberglass fibers infused with a polyester resin. Additionally, the plate may be a solid material such as plastic. The preferred characteristics of the plate are that it be light weight and rigid to provide the desired structural strength to the arch area of the midsole without significantly increasing the weight of the sole. In the embodiment of the invention shown in the drawing figures, the plate 14 has a general rectangular configuration defined by its peripheral edge 60. As stated earlier, the plate peripheral edge has a vertical height that substantially corresponds and is equal to the vertical height of the first cavity perimeter wall 46. The plate 14 is positioned in the first cavity 42 where it rests on the first cavity bottom surface 44 and covers over the apertures 36. The bottom surface of the plate is visible from beneath the shoe sole through the apertures. With the plate positioned in the cavity, a top surface 62 of the plate is substantially flush with the bottom surface 54 of the second cavity and a top edge of the first cavity perimeter wall 46. The plate peripheral edge 60 corresponds to the perimeter wall, meaning it is positioned immediately adjacent the perimeter wall 46 of the first cavity 42. The juxtaposition of the plate peripheral edge 60 and the first cavity perimeter wall 46 prevents movement of the plate in the first cavity. The presence of the plate in the midsole in the area of the apertures strengthens the midsole and compensates for any reduction in the midsole's strength due to the presence of the apertures. The apertures increase the flexibility of the midsole in the arch region and enhance the ability of the shoe sole to bend in the arch region.

The midsole pad 16 in the preferred embodiment of the invention also has a general rectangular configuration defined by a peripheral edge 66 of the pad. The pad peripheral edge 66 has a thickness that corresponds to the vertical height of the second cavity perimeter wall 56. The pad bottom surface is adhered to the second cavity bottom surface 54 and the plate top surface 62 with the pad positioned in the second cavity. The juxtaposition of the pad peripheral edge 66 and the second cavity perimeter wall 56 positions the pad relative to the plate 14 so that a margin border 68 of the pad extends completely around the peripheral edge 60 of the plate. The margin border 68 of the pad is positioned directly above the second cavity bottom surface 54. The margin border surrounds a center portion 70 of the pad that is positioned directly above the top surface of the composite plate 14. The vertical height of the pad corresponding with the height of the second cavity perimeter wall 56 positions a top surface 72 of the pad flush with the top edge of the second cavity perimeter wall and the midsole top surface 28. The overlapping of the midsole pad margin border 68 over the composite plate peripheral edge 60 enhances the cushioning effect of the pad over the edge. In testing of the shoe sole construction of the invention, it was found that the overlap of the pad margin border 68 over the plate peripheral edge 60 enhanced the cushioning of the pad over the plate, more so than a pad having a peripheral edge that corresponded in size and shape to the peripheral edge of the plate. Providing the midsole pad 16 with a larger peripheral dimension than the plate 14, gives the midsole a consistent, cushioned feel to the foot and prevents the edges of the plate from being felt by the foot in use of the shoe.

In positioning of the plate and its covering pad in the shoe sole, the peripheries of the plate and pad are spaced from the opposite lateral sidewalls of the shoe sole. This spacing ensures that the margin boundary of the pad surrounding the peripheral edge of the plate is sufficiently large to cushion the plate and prevent the shoe wearer's foot from detecting the presence of the plate edge in use of the shoe. However, it should be appreciated that the opposite lateral sides of both the plate and its covering pad could be extended to the opposite lateral sidewalls of the shoe sole. In such a configuration, the opposite lateral edges of the pad and the opposite lateral edges of the plate would be positioned adjacent each other and the pad would not extend beyond the plate at the opposite lateral sides of the shoe sole. However, at the opposite longitudinal edges of the pad and plate, the pad would still extend beyond the opposite longitudinal edges of the plate by the margin border. The overlap of the forward and rearward edges or opposite longitudinal edges of the pad over the opposite forward and rearward or opposite longitudinal edges of the plate would ensure that the presence of the forward and rearward edges of the plate in the midsole would not be detected by the shoe wearer's foot.

As stated earlier, the midsole pad is preferably constructed of a polyester, polyurethane blend, and may also be constructed entirely of polyurethane or ethylvinyl acetate. Depending on the relative dimensions of the midsole, plate, and pad, various different midsole materials may be employed in construction of the shoe sole of the invention. In the preferred construction, with the midsole being constructed of polyurethane and the midsole pad constructed of the polyester/polyurethane blend, the first and second cavities are recessed a total depth of 2 mm below the midsole top surface. The depth of the second cavity alone ranges between 1 and 1½ mm with the depth of the first cavity alone ranging between 1 and ½ mm, respectively. The width of the pad margin border 68 and the corresponding width of the second cavity bottom surface 54 is 10 mm. With the component parts of the invention having these dimensions, the midsole has a substantially consistent Shore hardness in a range of 55 to 60 across its top surface whether measured over the forefoot or heel regions of the midsole or over the intermediate arch region of the midsole encapsulating the plate.

While the present invention has been described by reference to a specific embodiment, it should be understood that modifications and variations of the invention may be constructed without departing from the scope of the invention defined in the following claims.

What is claimed is:

1. A shoe sole construction comprising:

a shoe sole having opposite top and bottom surfaces and a peripheral sidewall extending completely around the shoe sole and defining a periphery of the shoe sole;

at least one aperture extending through the shoe sole between the top and bottom surfaces, said peripheral sidewall completely surrounding the aperture;

a support plate positioned on the shoe sole and over the aperture such that the support plate completely covers the aperture, the support plate having a peripheral edge that surrounds the support plate; and a pad positioned on the shoe sole covering over the support plate, the pad having a peripheral edge that is at least as large as the support plate but is smaller than the periphery of the shoe sole;

the shoe sole being configured so that the support plate is open to atmosphere via the aperture.

2. The shoe sole construction of claim 1, wherein:

the pad peripheral edge is dimensioned larger than the support plate peripheral edge so that the entire peripheral edge of the pad surrounds and is spaced from the peripheral edge of the support plate.

3. The shoe construction of claim 2, wherein:

the pad peripheral edge is dimensioned smaller than the peripheral sidewall of the shoe sole so that the entire peripheral edge of the pad is surrounded by and spaced from the peripheral sidewall of the shoe sole.

4. The shoe sole construction of claim 1, wherein:

the aperture has a perimeter wall formed in the shoe sole, the aperture perimeter wall extends completely around the aperture and the shoe sole peripheral sidewall completely surrounds and is spaced from the aperture perimeter wall.

5. The shoe sole construction of claim 1, wherein:

the support plate has a thickness; and a first cavity is recessed into the shoe sole from the top surface, the first cavity communicates with the aperture and has a perimeter wall that extends completely around the aperture, the perimeter wall has a height that is substantially equal to the thickness of the support plate and the support plate is positioned in the first cavity with a top edge of the first cavity perimeter wall being substantially flush with a top surface of the support plate.

6. The shoe sole construction of claim 5, wherein:

the pad has a thickness; and a second cavity is recessed into the shoe sole from the top surface, the second cavity is positioned above and communicates with the first cavity and has a perimeter wall that extends completely around the first cavity perimeter wall, the second cavity perimeter wall has a height that is substantially equal to the pad thickness and the pad is positioned in the second cavity with the top surface of the shoe sole being substantially flush with a top surface of the pad.

7. The shoe sole construction of claim 6, wherein:

the second cavity perimeter wall is spaced from the periphery of the shoe sole.

8. The shoe sole construction of claim 1, wherein:

the shoe sole is a midsole constructed of a material selected from the group consisting of polyurethane, polyester, ethyl vinyl acetate, and combinations thereof and the pad is constructed of a material selected from the group consisting of polyurethane, polyester, ethyl vinyl acetate, and combinations thereof.

9. The shoe sole construction of claim 8, wherein:

the support plate is constructed of fiberglass.

10. The shoe sole construction of claim 1, wherein:

the pad has a margin border that completely surrounds the pad and a center portion that is surrounded by the margin border, the pad center portion is positioned directly above the support plate and the pad margin border completely surrounds the support plate peripheral edge and is positioned directly above the shoe sole.

11. The shoe sole construction of claim 1, wherein:

the support plate is of a rigid material.

12. The shoe sole construction of claim 11, wherein:

the support plate is of a fibrous weave infused with a resinous material.

13. A shoe sole construction comprising:

a shoe sole having opposite top and bottom surfaces and a peripheral sidewall completely surrounding the shoe sole;

at least one aperture extending through the shoe sole between the top and bottom surfaces, the aperture having a closed perimeter spaced from the peripheral sidewall of the shoe sole;

a first cavity recessed into the shoe sole from the top surface, the first cavity communicating with the aperture and the first cavity having a perimeter that is spaced from and completely surrounds the aperture perimeter and is spaced from the peripheral sidewall of the shoe sole;

a second cavity recessed into the shoe sole from the top surface, the second cavity communicating with the first cavity and communicating with the aperture through the first cavity, and the second cavity having a perimeter that is spaced from and completely surrounds the first cavity perimeter and is spaced from the peripheral sidewall of the shoe sole;

a support plate positioned in the first cavity covering over the aperture; and, a pad positioned in the second cavity and over the aperture such that the pad completely covers the support plate.

14. The shoe construction of claim 13, wherein:

the shoe sole is constructed of material selected from the group consisting of polyurethane, polyester, ethyl vinyl acetate, and combinations thereof and the pad is constructed of material selected from the group consisting of polyurethane, polyester, ethyl vinyl acetate, and combinations thereof.

15. The shoe construction of claim 13, wherein:

the support plate is constructed of a graphite and fiberglass weave.

16. The shoe sole construction of claim 13, wherein:

the support plate has a thickness and the first cavity has a perimeter wall with a top edge extending around the first cavity perimeter, and the support plate thickness is substantially equal to a height of the first cavity perimeter wall so that the top edge of the perimeter wall is substantially flush with a top surface of the support plate positioned in the first cavity.

17. The shoe sole construction of claim 16, wherein:

the perimeter wall of the first cavity has a perimeter configuration and the support plate has a peripheral edge having a peripheral configuration that corresponds with the perimeter configuration, whereby the support plate peripheral edge is positioned adjacent the first cavity perimeter wall with the support plate positioned in the first cavity.

18. The shoe sole construction of claim 16, wherein:

the pad has a thickness and the second cavity has a perimeter wall with a top edge extending around the second cavity perimeter, and the pad thickness is substantially equal to a height of the second cavity perimeter wall so that the top edge of the second cavity perimeter wall is substantially flush with a top surface of the pad positioned in the second cavity.

19. The shoe sole construction of claim 18, wherein:

the perimeter wall of the second cavity has a perimeter configuration and the pad has a peripheral edge with a peripheral configuration that corresponds with the perimeter configuration of the second cavity, whereby the pad peripheral edge is positioned adjacent the second cavity perimeter wall with the pad positioned in the second cavity.

20. The shoe sole construction of claim 13, wherein:

the support plate is of a rigid material.

21. The shoe sole construction of claim 20, wherein:

the support plate is of a fibrous weave infused with a resinous material.

22. A shoe sole construction comprising:

a shoe sole having opposite top and bottom surfaces and a peripheral sidewall extending completely around the shoe sole;

at least one aperture through the shoe sole between the top and bottom surfaces, the aperture having a closed perimeter spaced from the peripheral sidewall of the shoe sole;

a first cavity in the shoe sole recessed below the shoe sole top surface, the first cavity having a bottom surface through which the aperture passes, and a perimeter wall that extends around the first cavity bottom surface;

a second cavity in the shoe sole recessed below the shoe sole top surface, the second cavity having a bottom surface below which the first cavity is recessed, and a perimeter wall that extends around the second cavity bottom surface;

a rigid support plate positioned in the first cavity on the first cavity bottom surface; and a pad positioned in the second cavity on the second cavity bottom surface.

23. The shoe construction of claim 22, wherein:

the aperture has a perimeter wall that passes through the shoe sole from the first cavity bottom surface to the bottom surface of the shoe sole, the aperture perimeter wall completely surrounds the aperture, the first cavity bottom surface completely surrounds the aperture perimeter wall, and the second cavity bottom surface completely surrounds the first cavity perimeter wall.

24. The shoe sole construction of claim 22, wherein:

the support plate has a peripheral edge positioned adjacent the first cavity perimeter wall and the pad has a peripheral edge positioned adjacent the second cavity perimeter wall, and the pad has a peripheral margin that covers over the first cavity perimeter wall and the support plate peripheral edge.

25. The shoe sole construction of claim 24, wherein:

the pad has a center portion that is surrounded by the peripheral margin and the pad center portion is positioned directly above the support plate and the pad peripheral margin is positioned directly above the second cavity bottom surface.

26. The shoe sole construction of claim 22, wherein:

the support plate is constructed of fiberglass and the shoe sole and pad are constructed of midsole materials.

27. The shoe sole construction of claim 22, wherein:

the support plate has a top surface that is substantially flush with the second cavity bottom surface and the pad has a top surface that is substantially flush with the shoe sole top surface.

28. The shoe sole construction of claim 22, wherein:

the support plate is of a fibrous weave infused with a resinous material.

* * * * *